United States Patent [19]

York

[11] 4,106,504

[45] Aug. 15, 1978

[54] PORTABLE RECOMPRESSION CHAMBER WITH AIR SCRUBBER

[75] Inventor: Floyd L. York, Honolulu, Hi.

[73] Assignee: The United States of America as represented by the Secretary of the Navy, Washington, D.C.

[21] Appl. No.: 747,833

[22] Filed: Dec. 6, 1976

[51] Int. Cl.[2] ..... B63C 11/32

[52] U.S. Cl. ..... 128/204; 128/142 R

[58] Field of Search ..... 128/204, 205, 298, 1 R, 128/1 B, 191 R, 191 A, 36, 142 R, 142.2, 142.3

[56] References Cited

U.S. PATENT DOCUMENTS

| | | | |
|---|---|---|---|
| 3,358,683 | 12/1967 | Goitein | 128/204 |
| 3,877,427 | 4/1975 | Alexeev et al. | 128/204 |

OTHER PUBLICATIONS

Riegel, One-Man Portable Recompression Chamber; Working Diver Symposium Proceeding, 1974, pp. 219–235.

*Primary Examiner*—Robert W. Michell
*Assistant Examiner*—Henry J. Recla
*Attorney, Agent, or Firm*—Richard S. Sciascia; Ervin F. Johnston

[57] ABSTRACT

An air supply system for a recompression chamber which includes inlet and outlet conduits which extend through the chamber. The inlet conduit is adapted for connection to a pressurized air source and the outlet conduit serves as a vent of chamber air. A fluid amplifier is located within the chamber and is responsive to a primary fluid flow for sucking in and discharging a secondary fluid flow. The inlet conduit is connected to the fluid amplifier for supplying air from the pressurized air source as the primary fluid flow so that the chamber air is sucked in and is discharged as the secondary fluid flow through the fluid amplifier. A secondary conduit is connected in parallel with the outlet conduit and is adapted for connection to the pressurized air source. Valve means is connected in the secondary conduit for selective blow down or exhaust of the chamber so that the chamber can be quickly compressed or decompressed at the start or end of chamber use. An air scrubber may be located in the chamber, and a second fluid amplifier may be located outside the chamber and connected therethrough for conserving on the pressurized air.

12 Claims, 3 Drawing Figures

PORTABLE RECOMPRESSION CHAMBER WITH AIR SCRUBBER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

One of the most serious hazards to divers is decompression sickness which is commonly known as the bends. The average human body, at sea level, contains about one liter of dissolved nitrogen. For each atmosphere in depth that a diver ascends into the ocean his body will in time absorb an additional liter of nitrogen. The full time required for complete saturation at any particular atmospheric depth is about 24 hours.

The absorption of nitrogen is accomplished by breathing in the higher pressure air. In the lungs the blood absorbs the nitrogen, and as the blood passes throughout the body, tissues will also absorb the nitrogen. Decompression sickness will not occur with a rapid descent into the ocean since the nitrogen is absorbed progressively as the diver breathes. However, when the diver ascends too quickly from an ocean depth the nitrogen within the diver's tissues cannot be passed quickly enough from the tissues to the blood, thence from the blood to the lungs and then exhaled by the diver. The consequence of this situation is that nitrogen bubbles form in the tissues and in the blood which causes pressure on nerves, the damage of delicate tissues, and a blockage of flow of blood to the vital organs. Symptoms may range from skin rash to mild discomfort and pain in the joints and muscles, to paralysis, numbness, hearing loss, vertigo, unconsciousness, and in extreme cases, death.

The treatment of decompression sickness is normally placement of the diver into a decompression chamber. The pressure within the chamber puts the nitrogen bubbles back into solution within the diver's body and allows him time to naturally expel the excess nitrogen through his lungs. In most situations the diver must be transported to a shore based decompression chamber either by the vehicle from which he is diving or by a rescue vehicle. This approach is very time consuming since death may result while the diver is awaiting his arrival at the decompression chamber. Accordingly, research is now being conducted to provide a portable decompression chamber which can be utilized on even small boats for compressing a diver back to an appropriate ocean depth as soon as he is brought aboard the boat. Such a portable decompression chamber is described in a patent to Donald Miller, U.S. Pat. No. 3,729,002.

Since the Miller patent there has been additional research to provide an improved air supply system for the portable decompression chamber. One important consideration is the scrubbing of the air breathed within the chamber so that carbon dioxide is removed. Research at Battelle Laboratories has resulted in the use of a fluid amplifier in the decompression chamber for circulating the air, and a scrubber located exterior the chamber for removing the carbon dioxide. However, the Battelle apparatus does not have the capability of single valve rapid pressurization or exhaust of the chamber, and the location of the scrubber outside the chamber results in heavy construction. Further, the Battelle apparatus has no provision for conserving the use of air from the pressurized air source. Other considerations include removing any vomit of the diver from the chamber and maintaining a desired pressure drop throughout the air supply system. A combination of these advantages has heretofore been unattained.

SUMMARY OF THE INVENTION

The present invention has accomplished the aforementioned advantages by providing an air supply system which includes inlet and outlet conduits which extend through the chamber. The inlet conduit is adapted for connection to a pressurized air source and the outlet conduit serves as a vent for chamber air. A fluid amplifier is located within the chamber and is responsive to a primary flow for sucking in and discharging a secondary fluid flow. The inlet conduit is connected to the fluid amplifier for supplying air from the pressurized air source as the primary fluid flow so that the chamber air is sucked in and is discharged as the secondary fluid flow through the fluid amplifier. A secondary conduit is connected in parallel with the outlet conduit and is connected at one end to the pressurized air source. A valve is interconnected in the secondary conduit for selective blow down or exhaust of the chamber so that the chamber can be quickly compressed or decompressed at the start or at the end of chamber use. Another valve is interconnected in the outlet conduit for adjusting the flow of chamber air vented, which in turn establishes the back pressure within the chamber. The pressure regulator is interconnected within the inlet conduit for maintaining a predetermined $\Delta P$ loss in the system. A $CO_2$ scrubber is located within the chamber for removing $CO_2$, and a trough is located within the chamber for removing any vomit of the diver. Air from the pressurized air source is conserved by utilizing a second fluid amplifier exterior of the chamber for introducing ambient air into the chamber until the chamber is fully expanded.

OBJECTS OF THE INVENTION

An object of the invention is to provide the aforementioned advantages for a recompression chamber.

Another object is to provide a recompression chamber air supply system which will revitalize stale air and enable quick compression of the chamber to bring the diver to a desirable ocean depth pressure.

A further object is to provide a portable recompression chamber air supply system which scrubs air breathed by the diver, enables quick compression or decompression of the chamber, maintains a constant selected ocean depth pressure, regulates a desired $\Delta P$ within the system and removes vomit of the diver.

These and other objects of the invention will become more readily apparent from the ensuing specification when taken together with the drawings.

DESCRIPTION OF THE PREFERRED EMBODIMENT

Figure 1:
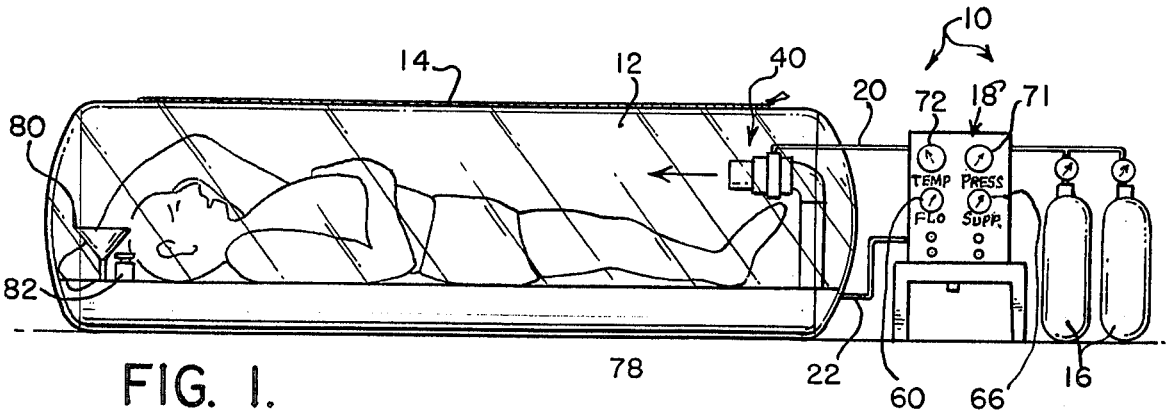
FIG. 1 is a side schematic view of an exemplary portable recompression chamber with a diver located therein.

Referring now to the drawing, wherein like reference numerals designate like or similar parts throughout the several views there is illustrated in FIG. 1 an air supply system, generally designated at 10, for a portable recompression chamber 12. The portable recompression chamber 12 may be an elongated inflatable bag which may be opened and closed by a zipper 14. The air supply system 10 may receive highly pressurized air from any suitable source, such as several SCUBA tanks 16. A console 18 may be provided for displaying the various dials, meters, and mounting the valves for operating the system.

Figure 2:
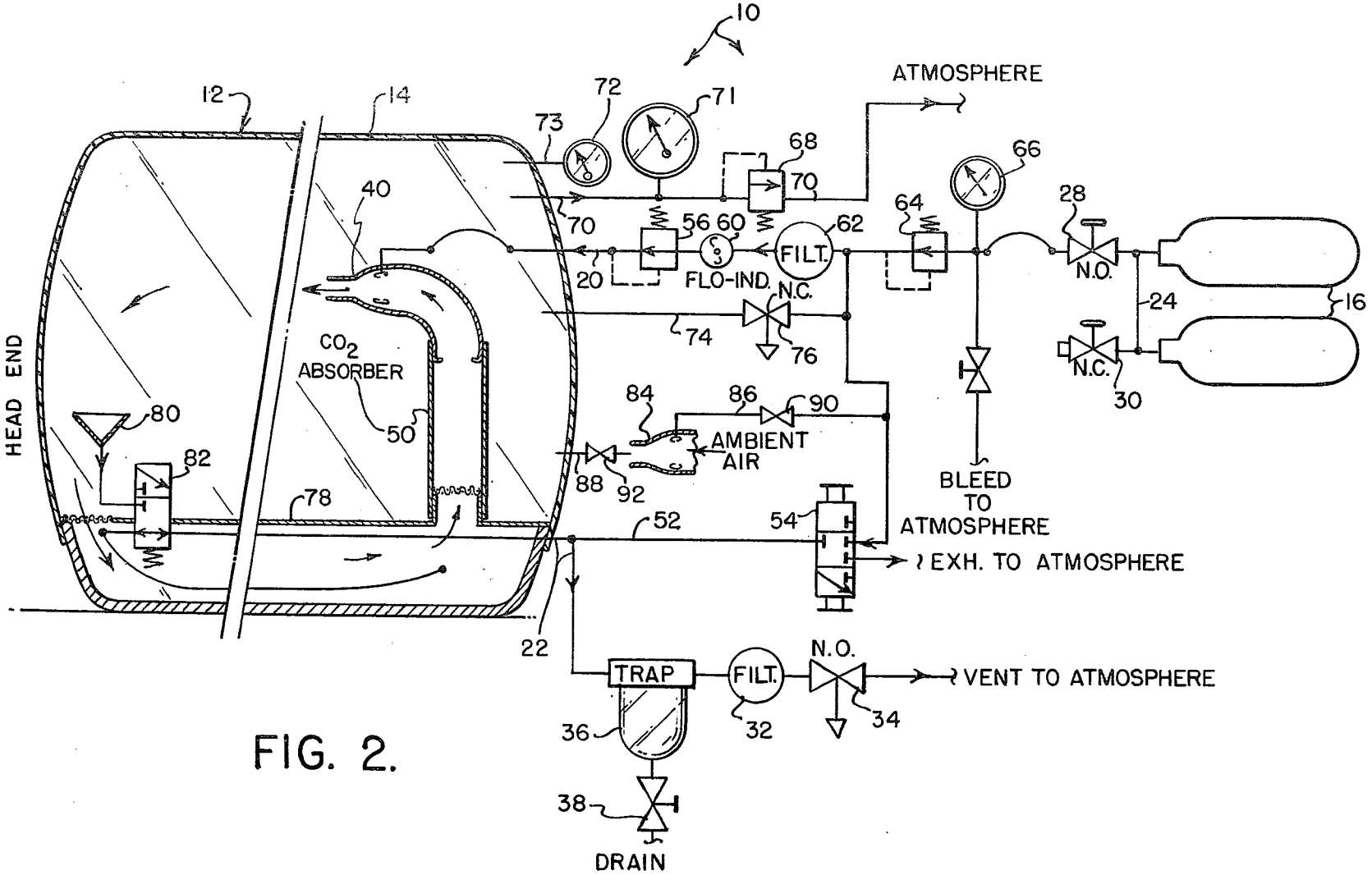
FIG. 2 is a schematic illustration of the air supply system for the portable recompression chamber.

As illustrated in FIG. 2, the air supply system 10 may include inlet and outlet conduits 20 and 22, which sealably extend through the chamber 12, and which have an interior and an exterior portion with respect to the chamber. The exterior portion of the inlet conduit 20 may be adapted by a manifold 24 for connection to a pair of SCUBA tanks 16. An on and off valve 28 may be provided for opening these tanks to the inlet conduit 20. If desired, another on and off valve 30 with a fitting may be connected to the manifold 24 for supplying air for other purposes. The outlet conduit 22 serves as a vent of chamber air and may be provided with a filter 32 and an adjustable on and off valve 34. The valve 34 establishes a back pressure within the chamber 12 and is important for maintaining the desired ocean depth pressure within the chamber 14. The outlet conduit 22 may also be provided with a trap 36 and a drain 38 which will be described in more detail hereinafter.

Figure 3:
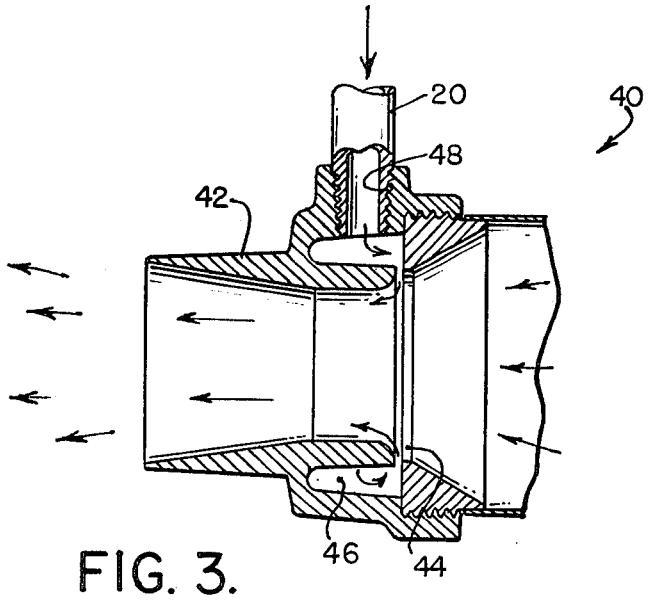
FIG. 3 is a cross-sectional view of a component (fluid amplifier) of the air supply system.

A fluid amplifier means 40 is located within the chamber 12 and is responsive to a primary fluid flow for sucking in and discharging a secondary fluid flow. While the fluid amplifier means may be a venturi or an ejector, it is preferred that it be a Coanda nozzle 42, as illustrated in FIG. 3. The Coanda nozzle 42 may be provided with an interior annular slot 44 which is in communication with a plenum chamber 46. The plenum chamber 46 may be provided with highly pressurized primary air through a fitting 48. With this arrangement, the highly pressurized primary air is restricted in slot 44, and immediately after leaving the slot flows along the interior wall of the nozzle 42. Because of the Coanda effect its primary stream of fast moving air attaches itself to the wall and is caused to turn and move through the throat of the nozzle picking up the still particles of secondary air as it moves therealong. This causes a suction at the larger end of the nozzle and an amplification of air which is ejected from the opposite end of the nozzle. The amplification of primary to secondary air can be as high as 40 to 1 depending upon the design of the nozzle. Such a nozzle is obtainable from the Vortec Corporation in Cincinnati, Ohio. One of the disadvantages of the Coanda nozzle is that it does not build up the desired ocean depth pressure within the chamber quickly enough, and it is this disadvantage that the present invention overcomes.

The interior portion of the inlet conduit 20 is connected to the fluid amplifier means 40 for supplying air from the pressurized air source 16 as primary fluid flow so that the chamber air is sucked in and is discharged as the secondary fluid flow through the fluid amplifier means. With this arrangement as much as 40 times as much chamber air can be pushed through the fluid amplifier 40 as pressurized air injected therein. This is especially useful for enabling the scrubbing of the chamber air to remove the carbon dioxide therefrom. This may be accomplished by mounting a $CO_2$ scrubber 50 to the sucking inlet side of the fluid amplifier means 40, as illustrated in FIG. 2.

A secondary conduit 52 may be connected in parallel with the outlet conduit 22, and may have an end located outside the chamber for connection to the pressurized air source 16. Valve means 54 may be interconnected in the secondary conduit 52 for selective blow down or exhaust of the chamber 14 so that the chamber can be quickly compressed or decompressed at the start or end of chamber use. This combination is especially desirable since the pressurization of chamber 14 would be slow if simply the fluid amplifier 40 was utilized for that purpose. Valve means 54 may be a three way, three position valve with push buttons for pushing for the desired blow down or exhaust of the chamber 14.

A pressure regulator means 56 may be interconnected in the inlet conduit 20 for maintaining a predetermined $\Delta P$ loss of primary air (pressurized air from source 16) in the fluid amplifier means 40. The pressure regulator means 56 may be a pressure feedback valve which closes the flow of air through the inlet conduit 20 when a preset back pressure is presented at the downstream side of the valve. The inlet conduit 20 may be further provided with a flow indicator 60, filter 62, and a pressure regulator 64 for regulating a minimum pressure which is required to operate the system. The pressure within the compressed air tanks 16 may be indicated by a meter 66.

A relief valve 68 may be connected to the chamber 12 by a conduit 70 for relieving pressure in the chamber when it exceeds a preset amount. Chamber pressure may be indicated by a gauge 71 which is also connected to the chamber by the conduit 70. A temperature gauge 72, which is connected to the chamber by a conduit 73, may be utilized for indicating chamber temperature. Further, an emergency bypass conduit 74 may be connected between the chamber 12 and the pressure tanks 16 for quickly pressurizing the chamber in the event the normal metered air supply should become unworkable. A normally closed on and off valve 76 may be provided for operating this emergency bypass conduit 74.

The chamber 12 is provided with a floor 78 for supporting the diver and for forming a bottom plenum or duct for circulating air. The outlet conduit 22 may extend therebelow for blow down or exhaust of the chamber. At one end of the floor 78 there may be provided a trough 80 which is capable of receiving any vomit from the diver, should he become nauseated. A trough 80 may be connected to the outlet conduit 22 by a two way, two position valve 82 which normally closes the trough to the conduit 22, but upon pushing to its second position opens the trough 80 to the conduit 22 and enables a suction of the vomit through the conduit to the trap 36 where it may be drained by the drain 38. When the valve 82 closes the trough to conduit 22, the conduit operates in its normal way to withdraw air from the chamber and vent it through the valve 34. As stated hereinabove, the valve 34 controls the back pressure within the chamber 12 and establishes the ocean depth pressure desired to alleviate the diver of his decompression sickness.

Air from the pressurized scuba tanks 16 is conserved in the recompression chamber apparatus by utilizing a second fluid amplifier 84 which is located exterior the chamber 12. This fluid amplifier is responsive to a primary fluid flow from the scuba tanks for sucking in ambient air outside the chamber. The fluid amplifier 84 is the same as fluid amplifier 40 except that the fluid amplifier 84 sucks in ambient air instead of secondary chamber air. A first conduit means 86 feeds the pressurized air from the scuba tanks to the fluid amplifier 84 and a second conduit means 88 extends through the chamber 12 for feeding discharged ambient air into the chamber. A valve 90 is interconnected in the first conduit 86 for turning the pressurized air on or off, and a valve 92 is interconnected in the second conduit 88 for turning the discharged air from the fluid amplifier on and off. The fluid amplifier 84 is especially useful for bringing a collapsed chamber 14 up to its fully expanded condition with a minimum use of pressurized air from the scuba tanks 16. If the fluid amplifier 40 is utilized for this purpose then pressurized air from the scuba tanks is the only air available for expanding the chamber, whereas if the fluid amplifier 84 is initially utilized for this purpose then the user can capitalize on the 40-1 ratio in using primarily ambient air for this purpose. After the chamber is fully expanded the valves 90 and 92 are closed, after which the fluid amplifier 40 or the valve 54 can be operated to bring the chamber up to the desired pressure for treating the diver.

OPERATION OF THE INVENTION

In the operation of the invention a diver is placed on the floor 78 of the chamber 12 and the zipper 14 is closed. The valves 90 and 92 are opened and the fluid amplifier 84 is operated to fully expand the chamber 12 to ambient pressure. The valves 90 and 92 are then closed. The chamber can then be brought up to the desired pressure for treating the diver by either quickly pressurizing the chamber through valve 54 or more slowly pressurizing the chamber through the fluid amplifier 40. Ocean depth pressure as indicated by the meter 71. Should there be any malfunction of the valve 54 the valve 76 can be opened so that the conduit 74 provides the pressure quickly to the operating depth. Maintenance of this depth is obtained by selective operation of the valve 34. If the pressure should start to drop from the desired pressure the valve 34 is slightly closed, whereas if the pressure slightly rises above the operating pressure, the valve 34 is slightly opened. After the diver has been maintained at a desired pressure for a predetermined length of time, the valve 34 may be opened to lower the chamber pressure by progressive steps until all of the nitrogen bubbles have been eliminated from the blood and tissues of the diver. Should the diver become nauseated and vomit while he is in the chamber, he can direct this vomit into the trough 80 and push the valve 82 to eliminate the vomit from the chamber to the trap 36. After the diver has been fully treated, the valve 54 can be pushed to exhaust the chamber 12, after which the chamber can be opened and the diver removed therefrom.

Obviously, many modifications and variations of the present invention are possible in the light of the above teachings, and, it is therefore understood that within the scope of the disclosed inventive concept, the invention may be practiced otherwise than as specifically described.

What is claimed is:

1. An air supply system for a recompression chamber comprising:

a chamber;

inlet and outlet conduits sealably extending through the chamber so that each conduit has an interior and an exterior portion with respect to the chamber;

the exterior portion of the inlet conduit being adapted for connection to a pressurized air source and the outlet conduit serving as a vent of chamber air;

fluid amplifier means located within the chamber for sucking in and discharging a secondary fluid flow upon receiving a primary fluid flow;

the interior portion of the inlet conduit being connected to the fluid amplifier means for supplying air from the pressurized air source as said primary fluid flow so that chamber air is sucked in and is discharged as the secondary fluid flow through the fluid amplifier means;

a secondary conduit connected in parallel with the outlet conduit and having an end located outside the chamber for connection to the pressurized air source;

valve means interconnected in the secondary conduit for selectively opening the secondary conduit to the pressurized air source so as to enable the chamber to be quickly compressed, or selectively opening the secondary conduit to space outside the chamber so as to exhaust the chamber, or selectively closing off the secondary conduit to both the pressurized air source and the space outside the chamber.

2. A system as claimed in claim 1 including;

valve means interconnected in the exterior portion of the outlet conduit for adjusting the flow of chamber air vented and the backpressure within the chamber.

3. A system as claimed in claim 1 wherein the fluid amplifier means includes:

a nozzle for entraining and recirculating the chamber air;

said nozzle having an interior annular slot; and the interior end of the inlet conduit being in communication with the annular slot, said nozzle and said annular slot including means for routing the pressurized air through the slot and into the nozzle thereby, sucking in and discharging the chamber air through the nozzle by the Coanda effect.

4. A system as claimed in claim 1 including:

pressure regulator means interconnected in the inlet conduit for maintaining a predetermined $\Delta P$ loss of pressurized air in the fluid amplifier means.

5. A system as claimed in claim 1 including:

$CO_2$ scrubber means located within the chamber and connected in series with the secondary fluid flow of the fluid amplifier at an upstream end of the fluid amplifier.

6. A system as claimed in claim 1 including:

a nozzle for entraining and recirculating the chamber air, said nozzle having an interior annular slot;

the interior end of the inlet conduit being in communication with the annular slot, said nozzle and said annular slot including means for routing the pressurized air through the slot and into the nozzle thereby, sucking in and discharging the chamber air through the nozzle by the Coanda effect; and pressure regulator means interconnected in the inlet conduit for maintaining a predetermined $\Delta P$ loss of the pressurized air across the annular slot of the fluid amplifier means.

7. A system as claimed in claim 6 including:

valve means interconnected in the exterior portion of the outlet conduit for adjusting the flow of chamber air vented and the backpressure within the chamber.

8. A system as claimed in claim 7 including:

$CO_2$ scrubber means located within the chamber and connected in series with the secondary fluid flow of the fluid amplifier at an upstream end of the fluid amplifier.

9. A system as claimed in claim 8 including:

a trough located within the chamber and connected into the interior portion of the outlet conduit;

valve means for opening and closing the trough to the outlet conduit; and a trap interconnected in the exterior portion of the outlet conduit.

10. A system as claimed in claim 9 including:

second fluid amplifier means located exterior the chamber for sucking in and discharging ambient air from outside the chamber upon receiving pressurized air from said pressurized air source;

first conduit means adapted for connection to the pressurized air source for feeding the primary fluid flow to the second fluid amplifier means;

second conduit means extending through the chamber for feeding discharged ambient air from the second fluid amplifier means into the chamber;

valve means interconnected in the first conduit means for turning the primary air on or off to the second fluid amplifier means; and valve means interconnected in the second conduit means for turning the discharged air on or off;

whereby the chamber can be fully expanded to ambient pressure before commencing over pressurization through the first mentioned fluid amplifier means, thus minimizing the expenditure of air from the pressurized air source.

11. A system as claimed in claim 1 including:

second fluid amplifier means located exterior the chamber for sucking in and discharging ambient air from outside the chamber upon receiving pressurized air from said pressurized air source;

first conduit means adapted for connection to the pressurized air source for feeding the primary fluid flow to the second fluid amplifier means;

second conduit means extending through the chamber for feeding discharged ambient air from the second fluid amplifier means into the chamber;

valve means interconnected in the first conduit means for turning the primary air on or off to the second fluid amplifier means; and valve means interconnected in the second conduit means for turning the discharged air on or off;

whereby the chamber can be fully expanded to ambient pressure before commencing over pressurization through the first mentioned fluid amplifier means, thus minimizing the expenditure of air from the pressurized air source.

12. An air supply system for a recompression chamber comprising:

a chamber;

inlet and outlet conduits sealably extending through the chamber so that each conduit has an interior and an exterior portion with respect to the chamber;

the exterior portion of the inlet conduit being adapted for connection to a pressurized air source and the outlet conduit serving as a vent of chamber air;

fluid amplifier means located within the chamber for sucking in and discharging a secondary fluid flow upon receiving a primary fluid flow;

the interior portion of the inlet conduit being connected to the fluid amplifier means for supplying air from the pressurized air source as said primary fluid flow so that chamber air is sucked in and is discharged as the secondary fluid flow through the fluid amplifier means;

a secondary conduit connected in parallel with the outlet conduit and having an end located outside the chamber for connection to the pressurized air source;

valve means interconnected in the secondary conduit for selectively opening the secondary conduit to the pressurized air source so as to enable the chamber to be quickly compressed, or selectively opening the secondary conduit to space outside the chamber so as to exhaust the chamber, or selectively closing off the secondary conduit to both the pressurized air source and the space outside the chamber;

a trough located within the chamber and connected into the interior portion of the outlet conduit;

valve means for opening and closing the trough to the outlet conduit; and a trap interconnected in the exterior portion of the outlet conduit.

* * * * *